US006350017B1

(12) United States Patent
Kamada

(10) Patent No.: US 6,350,017 B1
(45) Date of Patent: Feb. 26, 2002

(54) INK-JET PRINTER HEAD AND MANUFACTURING METHOD THEREOF

(75) Inventor: Hideki Kamada, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 72 days.

(21) Appl. No.: 09/580,644

(22) Filed: May 30, 2000

(30) Foreign Application Priority Data

May 31, 1999 (JP) ..... 11-151322

(51) Int. Cl.[7] ..... B41J 2/05
(52) U.S. Cl. ..... 347/63
(58) Field of Search ..... 347/63, 64, 56, 347/54, 71, 61, 62; 29/890.1; 430/311

(56) References Cited

U.S. PATENT DOCUMENTS 4,694,306 A 9/1987 Ikeda et al.
4,965,611 A 10/1990 Pan et al.
5,153,610 A 10/1992 Komuro et al.
5,580,468 A 12/1996 Fujikawa et al.

FOREIGN PATENT DOCUMENTS

EP 0 612 619 8/1994
EP 0 646 464 4/1995

*Primary Examiner*—Raquel Yvette Gordon
(74) *Attorney, Agent, or Firm*—Frishauf, Holtz, Goodman, Langer & Chick, P.C.

(57) ABSTRACT

Each of heating elements comprises a heating resistor, and a pair of a common electrode and an individual electrode formed on ends of said heating resistor so that a heating area of the heating resistor is exposed. A barrier layer covers the electrodes so that the electrodes are not exposed to the ink in the ink flow passage, that is, not only upper surface of the electrodes, but also edges thereof are covered with the barrier layer. The barrier layer is made of, for example, single atomic metal such as Ta and Ti, oxide, corrosion resistant amorphous alloy, titanium nitride, titanium-tungsten, or the like. The barrier layer has the thickness of 10 to 1,000 nm, and is made by electroless plating or the like. The barrier layer is effective in preventing not only corrosion but also migration as contact surface corrosion.

16 Claims, 6 Drawing Sheets

INK-JET PRINTER HEAD AND MANUFACTURING METHOD THEREOF

BACKGROUND OF THE INVENTION

1. Field of the Invention

The present invention relates to a print head of an ink-jet printer, which has resistance against corrosion by ink, thus, reliability is improved, and a method of manufacturing the print head.

2. Description of the Related Art

One of well known printers is an ink-jet printer. The ink-jet printer has a print head in which multiple nozzles for outputting ink droplets to a recording sheet of paper or textile are disposed, thus, images and characters are printed thereon. The ink-jet printer has several merits, for example, quiet operation, no fixing treatment, and easy full-color printing.

There are some methods for outputting the ink droplets. Typical ones are piezoelectric ink-jet, thermal ink-jet, and the like.

The piezoelectric ink-jet printer uses electromechanical transducers such as piezoelectric elements which mechanically deform ink chambers to produce alteration in ink pressure. The pressure alteration causes output of ink droplets through minute nozzles.

The thermal ink-jet printer employs minute heating elements in firing chambers. The heating elements forms bubbles of vapor in the ink in very short periods when electric current applied to the heating elements. Expansion of the bubble pushes out an ink droplet through a nozzle. The thermal ink-jet print head is categorized into two types, side shooter and roof shooter. In the side shooter type head, a bubble generated by a heating element expands and pushes ink in the direction parallel to the heating element surface to output an ink droplet through a nozzle which is placed away from the heating element. On the contrary, the roof shooter type head features that nozzles are formed just above heating elements. A bubble generated by the heating element pushes out ink in the vertical direction to output an ink droplet through the nozzle. It has been known that required power consumption of the roof shooter type head is less than that of the side shooter type head.

A roof shooter type head comprises multiple (for example, 64, 128, or 256) heating elements, drive circuits which drive the heating elements individually, ink passages, and nozzles. During manufacturing process, the roof shooter type heads formed on a silicon wafer having diameter of equal to or larger than 6 inch (approx. 15.24 cm). The wafer has 90 or more blocks (approx. 10×15 mm each), and the heads are formed at once so that one head is formed in one block. At that time, silicon LSI formation technique or thin film formation technique is used to form the print heads to have monolithic structure.

FIG. 1A is a plan view showing an ink output surface of a roof shooter type print head 1 for an ink-jet printer (hereinafter, referred to simply as print head 1). FIG. 1B is an enlarged diagram showing an area indicated by a broken-line square "a" in FIG. 1A. FIG. 1C is a cross sectional view along a line C–C' in FIG. 1B. In FIG. 1B, components under an orifice plate 14 are shown through it.

Drive circuits (not shown) are formed on a chip substrate 2 by LSI formation technique. A common ink supply groove (not shown) is formed on the chip substrate 2 by etching or the like. An insulation layer 3 (oxidized film) is formed on the chip substrate 2 on which the drive circuits and the common ink supply groove have been formed.

Plural lines (64, 128, or 256 lines) of heating resistor 4 is formed with thin film formation technique such as photolithography, between the drive circuits and the common ink supply groove. Further, common electrodes 6 and individual electrodes 7 for driving heating areas 5 on the heating resistor 4 are formed so that the heating area 5 of the heating resistor 4 are exposed. A set of one heating area 5, one common electrode 6, and one individual electrode 7 is a unit of one heating element.

The individual electrodes 7 are connected to electrode terminals of the drive circuits. A connection terminal 8 for connecting the common electrodes 6 to peripherals and another set of connection terminals 9 for connecting the drive circuits to peripherals are formed on the chip substrate 2.

A wall material layer is deposited onto the chip substrate 2 except the portion where the connection terminals 8 and 9 are formed. Then photolithography is performed to pattern the wall material layer, thus a wall 11 is formed. The wall 11 determines an ink flow passage 13.

The wall 11 includes comb like extensions 11-1. The wall 11 and its extensions 11-1 surrounds three sides of each heating area 5 to separate them from each other. Separated spaces above the heating areas 5 are firing chambers 12. Open side of each firing chamber 12 is connected to an ink flow passage 13 which is communicated with the common ink supply groove.

An orifice plate 14 is deposited onto the wall 11. Multiple nozzles 15 are formed in the orifice plate 14 so that a set of the nozzles 15 forms a nozzle line 16 being along a line of the heating areas 5. Thus, multiple print heads 1 are formed on the silicon wafer. The silicon wafer is finally diced so that chip substrates 2 each having the formed print head 1 thereon are separated from each other.

In the printer, ink is supplied to the firing chambers 12 via the common ink supply groove and the ink flow passage 13. For printing, electric current is selectively applied to the heating areas 5 in accordance with print data. Upon reception of the electric current, the heating area 5 heats ink for a very short time period, thus a bubble of vapor is generated at bottom of the ink layer. The bubble expands and pushes out an ink droplet through the ink nozzle 15 above the heating area 5. Size of the ink droplet is almost the same as that of the nozzle diameter when output. When the droplet reaches a sheet, it is broadened almost twice as large as the initial size.

Aluminum (Al) is a major material for electrodes such as the common electrode 6 and the individual electrode 7 because good conductivity is available with low cost. Since aluminum is amphoteric metal, it will be corroded gradually under ordinary acid or alkaline ink.

Gold (Au) is one of corrosion resistant material, therefore, it is suitable one for the common electrodes 6 and the individual electrodes 7. However, Au is likely to cause migration which diffuses ink into boundary between electrodes 617 and the heating resistor 4. This ink migration will separate the Au electrode from the heating resistor 4 eventually.

Such the corrosion of the electrodes 6 and 7 or separation of the electrodes from the heating resistor 4 will deteriorate print head performance, and the print head 1 will be broken eventually. Even if the electrodes 6 and 7 are not corroded by ink, humidity in the air causes the migration, therefore, the print head disorder may be prolonged but it will be also broken eventually.

SUMMARY OF THE INVENTION

It is an object of the present invention to provide an ink-jet printer head having resistance against corrosion and migration caused by ink, thus reliability is improved. It is another object of the present invention to provide a method for easy manufacture of a print head for an ink-jet printer having resistance against corrosion and migration caused by ink, thus reliability is improved.

An ink-jet printer head according to a first aspect of the present invention is an ink-jet printer head in which ink is pressed out in predetermined directions by vapor bubbles generated by heating the ink, the ink-jet printer head comprises:

an insulation substrate at least a surface thereof is an insulator;

a plurality of heating resistors which are formed on the insulation substrate, each of which has a heating area which emits heat when a predetermined voltage is applied thereto;

a pair of electrodes which is electrically connected to each of the heating areas;

a wall which is formed on the insulation substrate to determine an ink flow passage; and a barrier layer, having resistance against corrosion caused by the ink, which covers the electrodes so that the electrodes are not exposed to ink in the ink flow passage.

According to this invention, electrode corrosion caused by ink and migration are prevented. Thus, the ink-jet printer head has improved resistance against corrosion and migration caused by the ink. As a result, reliability of the ink-jet printer head improves.

The barrier layer may be made of amorphous metal alloy.

The barrier layer may be made by electroless plating. The electroless plating realizes uniform and constant barrier layer which firmly adheres to the electrodes.

The electrodes may be superimposed on the heating resistors except the heating areas. In this case, a contact layer which interconnects the electrodes and the heating resistors should be formed between the electrodes and the heating resistors. And the barrier layer may cover top surfaces and edges of the electrodes so that the electrodes are not exposed to the ink in the ink flow passage.

The heating areas may be uncovered by the barrier layer to be exposed.

The barrier layer, however, should be formed on each of the electrodes and predetermined regions on the heating areas. This structure successfully prevents migration at contact surfaces between the electrodes and the heating resistors.

A protective insulation film may be formed over the heating areas and the barrier layer. In this case, heating resistors may be made of Ta—Si—O—N, the barrier layer may be made of Ti—W, and the protective insulation film may be made of Ta—Si—O. This structure prevents a short circuit current from flowing through the ink in case of a monolithic ink-jet printer head. As a result, smooth ink flow is realized and reliability of the ink-jet printer head improves.

An ink-jet printer head according to a second aspect of the present invention is an ink-jet printer head in which ink is pressed out through nozzles in predetermined directions by providing pressure to the ink, the ink-jet printer head comprises:

pressure generators, disposed within an ink flow passage communicating to the nozzles, which provide the ink with pressure when a predetermined voltage is applied thereto;

electrodes which are terminals for providing the pressure generators with the predetermined voltage; and a barrier layer, having resistance against corrosion caused by the ink, which covers the electrodes so that the electrodes are not exposed to the ink in the ink flow passage.

This structure also realizes a reliable ink-jet printer head which has excellent resistance against corrosion and migration caused by ink.

A manufacturing method of an ink-jet printer head according to a third aspect of the present invention is a manufacturing method of an ink-jet printer head in which ink is pressed out in predetermined directions by vapor bubbles generated by heating the ink flowing in an ink flow passage, the method comprises:

forming a plurality of heating elements by forming heating resistors, each having a heating area which emits heat when a predetermined voltage is applied thereto, on an insulation substrate and forming pairs of electrodes on the heating resistors except the heating areas;

forming a barrier layer, having resistance against corrosion caused by the ink, which covers the electrodes so that said electrodes are not exposed to the ink in the ink flow passage.

According to the above invention, a reliable ink-jet printer head having excellent resistance against corrosion caused by ink is manufactured with easy process.

The forming barrier layer may comprise forming the barrier layer of amorphous metal alloy.

The forming barrier layer may comprise forming the barrier layer by plating. In this case, it is preferable that the barrier layer comprises forming the barrier layer by electroless plating. This method realizes a uniform and constant barrier layer which successfully protect the electrodes from ink.

The forming barrier layer comprises forming the barrier layer by photolithography. According to this method, corrosion at contact surfaces between the electrodes and the heating resistors, that is, the migration, is prevented effectively.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

First Embodiment

A print head for an ink-jet printer according to a first embodiment of the present invention will now be described with reference to accompanying drawings.

Figure 1A:
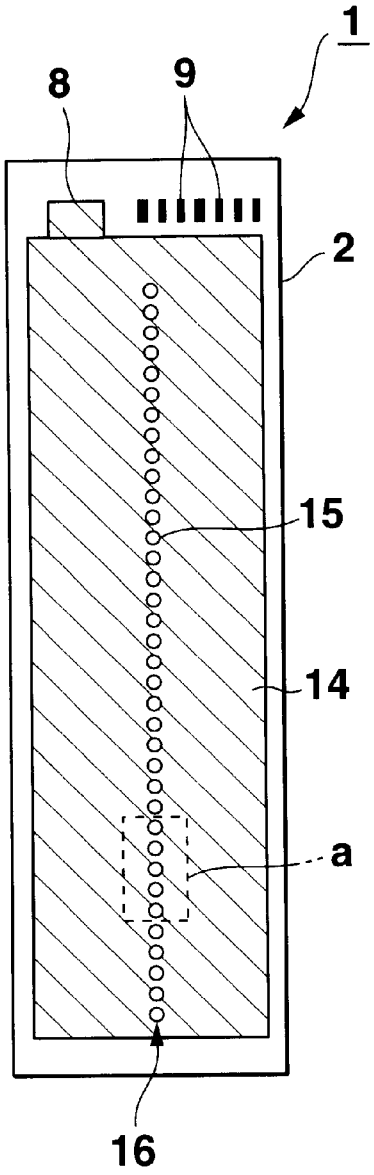
FIG.1A (PRIOR ART)
FIG. 1A is a plan view showing an ink output surface of a conventional print head in an ink-jet printer.
Figure 1B:
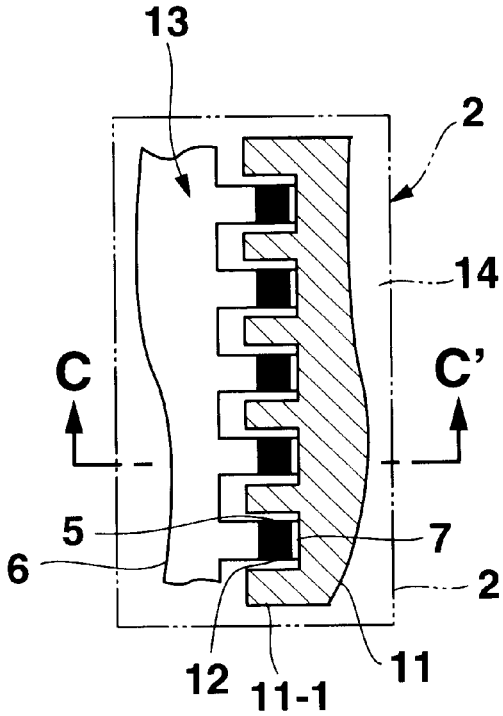
FIG.1B (PRIOR ART)
FIG. 1B is an enlarged plan view showing an area indicated by a broken-line square "a" in FIG. 1A.
Figure 1C:
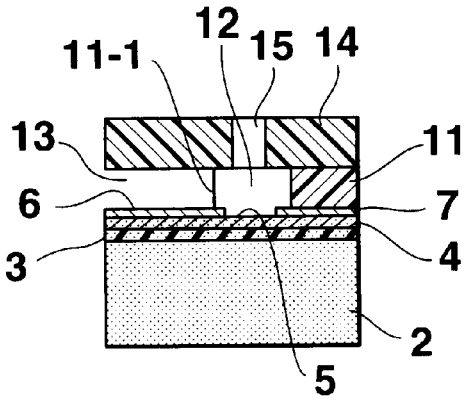
FIG.1C (PRIOR ART)
FIG. 1C is a cross sectional view along a line C–C' in FIG. 1B.
Figure 2A:
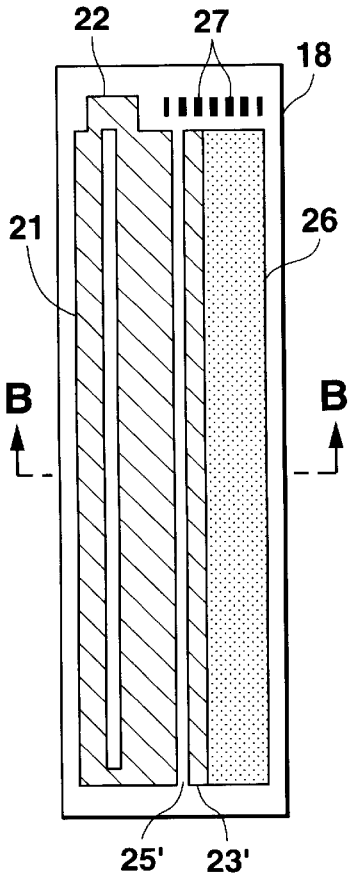
FIG. 2A is a plan view schematically showing the ink-jet printer head according to the first embodiment of the present invention when formation of heating elements is completed during the manufacturing process.
Figure 3A:
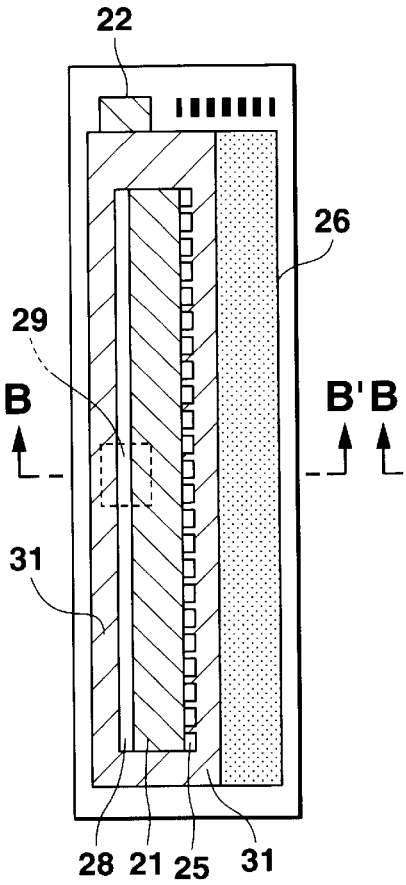
FIG. 3A is a plan view schematically showing the ink-jet printer head according to the first embodiment of the present invention when formation of a wall is completed during the manufacturing process.
Figure 4A:
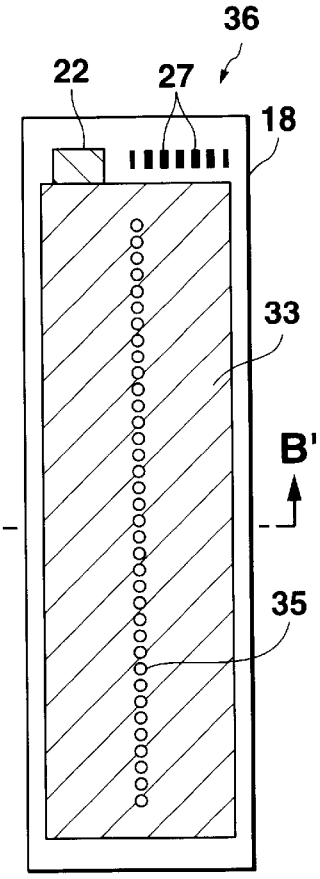
FIG. 4A is a plan view schematically showing the ink-jet printer head according to the first embodiment of the present invention when formation of orifices is completed during the manufacturing process.
Figure 2B:
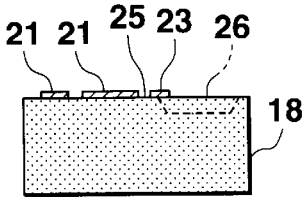
FIG. 2B is a cross sectional view of FIG. 2A along a line B–B'.
Figure 3B:
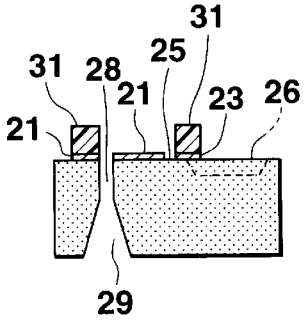
FIG. 3B is a cross sectional view of FIG. 3A along a line B–B'.
Figure 4B:
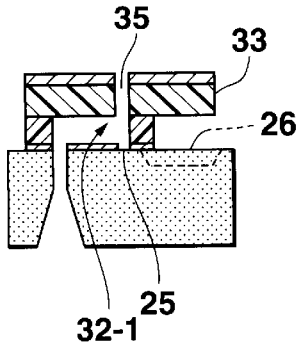
FIG. 4B is a cross sectional view of FIG. 4A along a line B–B'.

FIGS. 2A, 2B, 3A, 3B, 4A and 4B are diagrams schematically showing steps of manufacturing the print head according to the first embodiment. More precisely, FIGS. 2A, 3A, and 4A are plan views showing the manufacturing steps of the print head. FIG. 2B is a cross sectional view along a line B–B' in FIG. 2A, FIG. 3B is a cross sectional view along a line B–B' in FIG. 3A, and FIG. 4B is a cross sectional view along a line B–B' in FIG. 4A. The print head shown in those diagrams is one module in a full-color ink-jet printer. Regardless whether the full-color printer or a monochrome printer, the structure of each print head module is the same. In the full-color printer, a series of plural (generally four) print head modules are formed on one substrate. FIGS. 4A and 4B show nozzles (orifices) 35 whose number is 36. The number of the nozzles 35 depends on the product's concept. It may be, for example, 64, 128, or 256.

Figure 7A:
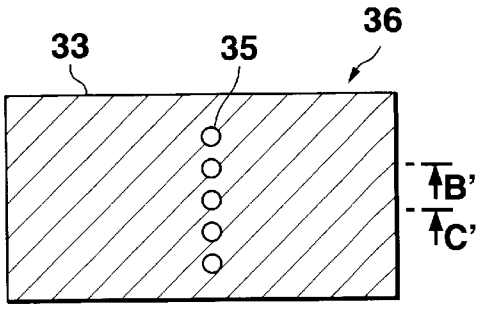
FIG. 7A is an enlarged plan view of FIG. 4A.
Figure 7B:
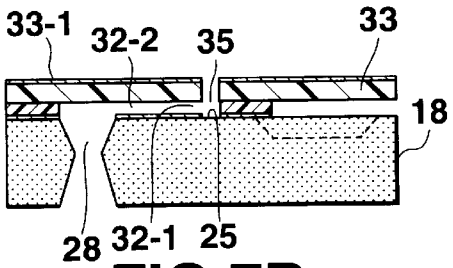
FIG. 7B is a cross sectional view of FIG. 7A along a line B–B'.
Figure 7C:
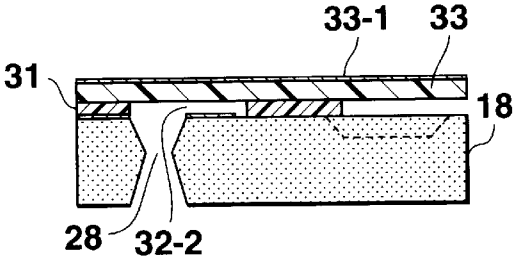
FIG. 7C is another cross sectional view of FIG. 7A along a line C–C'.
Figure 6A:
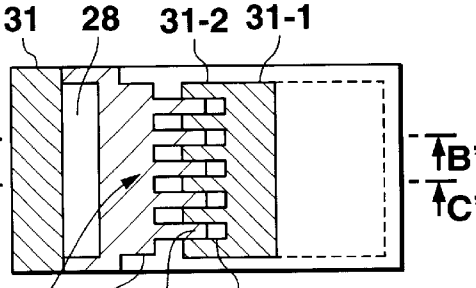
FIG. 6A is an enlarged plan view of FIG. 3A.
Figure 6B:
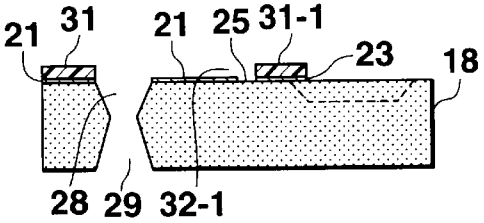
FIG. 6B is a cross sectional view of FIG. 6A along a line B–B'.
Figure 6C:
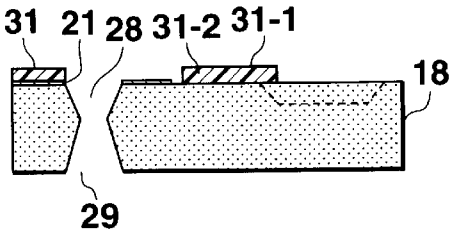
FIG. 6C is another cross sectional view of FIG. 6A along a line C–C'.
Figure 5A:
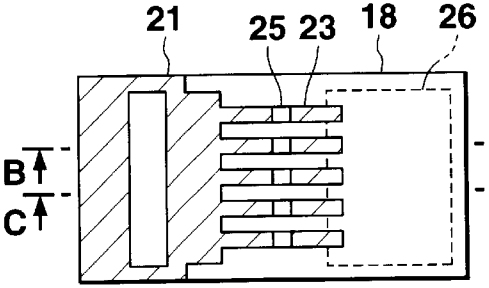
FIG. 5A is an enlarged plan view of FIG. 2A.
Figure 5B:
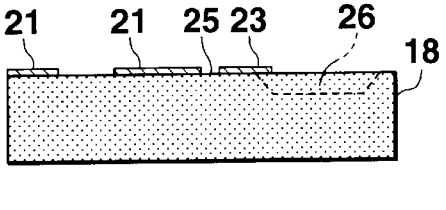
FIG. 5B is a cross sectional view of FIG. 5A along a line B–B'.
Figure 5C:
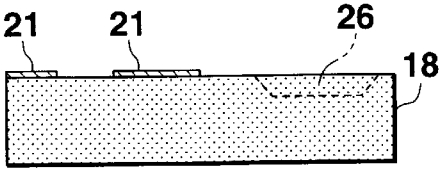
FIG. 5C is another cross sectional view of FIG. 5A along a line C–C'.

FIGS. 5A to 5C, FIGS. 6A to 6C, and FIGS. 7A to 7C are enlarged plan views and cross sectional views for explaining manufacturing process of the print head step by step. FIG. 5A is an enlarged plan view of FIG. 2A, FIG. 5B is a cross sectional view along a line B–B' in FIG. 5A, and FIG. 5C is a cross sectional view along a line C–C' in FIG. 5A. FIG. 6A is an enlarged plan view of FIG. 3A, FIG. 6B is a cross sectional view along a line B–B' in FIG. 6A, and FIG. 6C is a cross sectional view along a line C–C' in FIG. 6A. FIG. 7A is an enlarged plan view of FIG. 4A, FIG. 7B is a cross sectional view along a line B–B' in FIG. 7A, and FIG. 7C is a cross sectional view along a line C–C' in FIG. 7A. FIGS. 5A, 6A and 7A are simplified diagrams each showing just 5 nozzles 35 for easy explanation.

Fundamental manufacturing process will now be described first.

Step 1

A silicon wafer whose diameter is equal to or larger than 4 inches (approx. 10.16 cm) having a plurality of blocks therein is prepared. Print heads are formed on the blocks respectively. Drive circuits 26 and their terminals are formed on the blocks respectively by the LSI forming process. An insulation oxide film ($SiO_2$) having the thickness of 1 to 2 micrometers is formed on the silicon wafer. Thus, a chip substrate whose surface is insulated is formed.

Step 2

A heating resistor layer, a contact layer, and an electrode layer are deposited onto the chip substrate in this order. The heating resistor layer is made of 3-element material (tantalum-silicon-oxygen), or 4-element material (tantalum-silicon-oxygen-nitrogen). The contact layer is made of Ti—W, or the like. The electrode layer is made of Au, or the like. Those layers are deposited by the thin film forming technique. The electrode layer, the contact layer and the heating resistor layer are patterned by the photolithography technique. Thus, stripe shaped heating elements are formed. That is, the patterning forms pieces of striped heating resistor film, and electrode pieces comprising the electrode layer and the contract layer are formed so that a pair of the electrode pieces covers tips (ends) of each heating resistor piece, thus, center of each heating resistor piece is exposed. The exposed portions of the heating resistor pieces are heating areas. Positions of the heating areas depend on positions where the electrode pieces are formed.

FIGS. 2A, 2B and 5A–5C show the print head after the above steps 1 and 2 are completed.

An insulation layer 19 (shown in FIG. 9 whose explanation will be described later) is formed on the chip substrate 18 on which the drive circuits 26 have been formed. The striped heating resistor 24 (shown in FIG. 9 whose explanation will be described later) is formed on the chip substrate 18 on which the insulation layer 19 has been formed. A pair of a common electrode piece 21 and an individual electrode piece 23 are formed on each heating resistor piece 24 so that the heating area 25 is exposed. Thus, a plurality of heating elements each comprising the common electrode piece 21, the individual electrode piece 23, and the heating resistor piece 24 are formed. The heating elements are arranged in line at regular intervals (resistor line 25'). In fact, each of the common electrode piece 21 and the individual electrode piece 23 do not contact the heating resistor piece 24 directly, that is, the contact layer (not shown) intervenes therebetween. As shown in FIG. 2A, a power supply terminal 22 is formed, and it is connected to one end of the common electrode 21. The plurality of individual electrode pieces 23 form an individual electrode line 23'. The individual electrode line 23' is parallel to the drive circuit 26. A plurality of drive electrode terminals 27 are formed near one end of the drive circuit 26. The terminals 27 interconnect the drive circuit 26 and peripherals.

Step 3

The chip substrate is then coated with a to-be-wall layer made of an organic material such as photosensitive polyimide. The coated layer has the thickness of approximately 20 micrometers. The to-be-wall layer is patterned by photolithography technique or the like, and is subjected to curing under 300 to 400 degrees Celsius for 30 to 60 minutes. Thus, a wall whose height is approximately 10 micrometers is formed and fixed. The wall determines an ink flow passage communicating to each firing chamber where heating area 25 is disposed.

Step 4

Wet etching or sand blasting is carried out to groove the surface of the chip substrate, and a common ink supply groove is formed. Then, an ink inlet communicated with the common ink, supply groove which is opened through the back surface of the chip substrate is formed.

FIGS. 3A, 3B, and 6A–6C show the print head after the above steps 3 and 4 are completed.

A common ink supply groove 28 and an ink inlet 29 communicating to the common ink supply groove 28 are formed in the chip substrate 18. A wall 31 determines the ink flow passage. The wall 31 comprises a sealing wall 31-1 and partitions 31-2. The partitions 31-2 extend from the sealing wall 31-1 like a comb so that the heating areas 25 are separated from each other by the partitions 31-2. Individual ink flow passages 32-1 communicate respectively to the firing chambers above the heating areas 25. Thus, each of the heating areas 25 is surrounded by the sealing wall 31-1, a pair of the partitions 31-2, and one of the individual ink flow passages 32-1.

Step 5

An orifice plate (10 to 30 micrometers thick) made of polyimide is prepared. One surface of the orifice plate is coated with thermo-plastic polyimide until it has the thickness of, for example, 2 to 5 micrometers. The coated thermo-plastic polyimide acts as adherence between the orifice plate and the wall. The orifice plate is pressed to the wall under a temperature of 290 to 300 degrees Celsius, thus they are stuck to each other firmly. Then a metal film (Ni, Cu, or Al) of approximately 0.5 to 1 micrometer thick is formed on the orifice plate.

Step 6

The metal film on the orifice plate is patterned, thus a metal mask for selectively etching the orifice plate by dry etching is formed. Then, the helicon dry etching or the like is carried out to form multiple orifices, each having diameter of 14 to 26 micrometers, in the orifice plate. That is, multiple nozzles for outputting ink droplets are formed at once.

FIGS. 4A, 4B, and 7A–7C show the state immediately after the above steps 5 and 6 are completed.

As shown in FIG. 4A, an orifice plate 33 covers almost all areas on the chip substrate 18 except the power supply terminal 22 and the drive electrode terminals 27. Multiple minute spaces surrounded by the wall 31 and the orifice plate 33 are formed. Each space has the height of 10 micrometers. A common ink flow passage 32-2 having the height of 10 micrometers is formed between a set of the individual ink flows 32-1 and the common ink supply groove 28, thus they are communicated with each other. The nozzles 35 are formed in the orifice plate 33. The nozzles 35 are formed just above the heating areas 25 respectively. The nozzles 35 are formed by the dry etching with using a metal mask 33-1. Thus, a print head module 36 for a single color having a line of nozzles 35 whose number is 64, 128, or 256 is completed.

Accordingly, the nozzles 35 are formed in the orifice plate 33 so that the nozzles 35 are placed just above the heating areas 25 respectively, after the orifice plate 33 is adhered to the wall 31 on the chip substrate 18. This method is practical one because it improves productivity rather than a method in which an orifice plate 33 which previously has nozzles 35 is adhered to the wall 31.

In a case where the metal mask 33-1 for forming the nozzles 35 by the dry etching is made of Ni, Cu, or Al, selection ratio of resin to the metal mask 33-1 is approximately 100. In this case, necessary thickness of the metal mask 33-1 for etching the polyimide film (29 to 31 micrometer thick) is very thin (equal to or smaller than 1 micrometer).

The above steps 1 to 6 are performed under the chip substrates 18 are still on the silicon wafer. Next step 7 is a step for dicing. That is, the silicon wafer is diced along scribed lines by a dicing saw or the like. Thus, the silicon wafer is divided into multiple chip substrates 18. Each chip substrate 18 is bonded on a board, and a complete print head for practical use is produced.

A monochrome ink-jet printer employs the single print head module 36 having a line of the nozzles 35. For full-color printing, inks for subtractive primaries yellow (Y), magenta (M), and cyan (C), and black (Bk) for characters and black portions in an image are required. Therefore, at least four lines of the nozzles are necessary. According to the above described method, it is able to form a monolithic print head having four print head modules 36. The print head modules 36 are positioned precisely by a known semiconductor manufacturing technique.

Figure 8B:
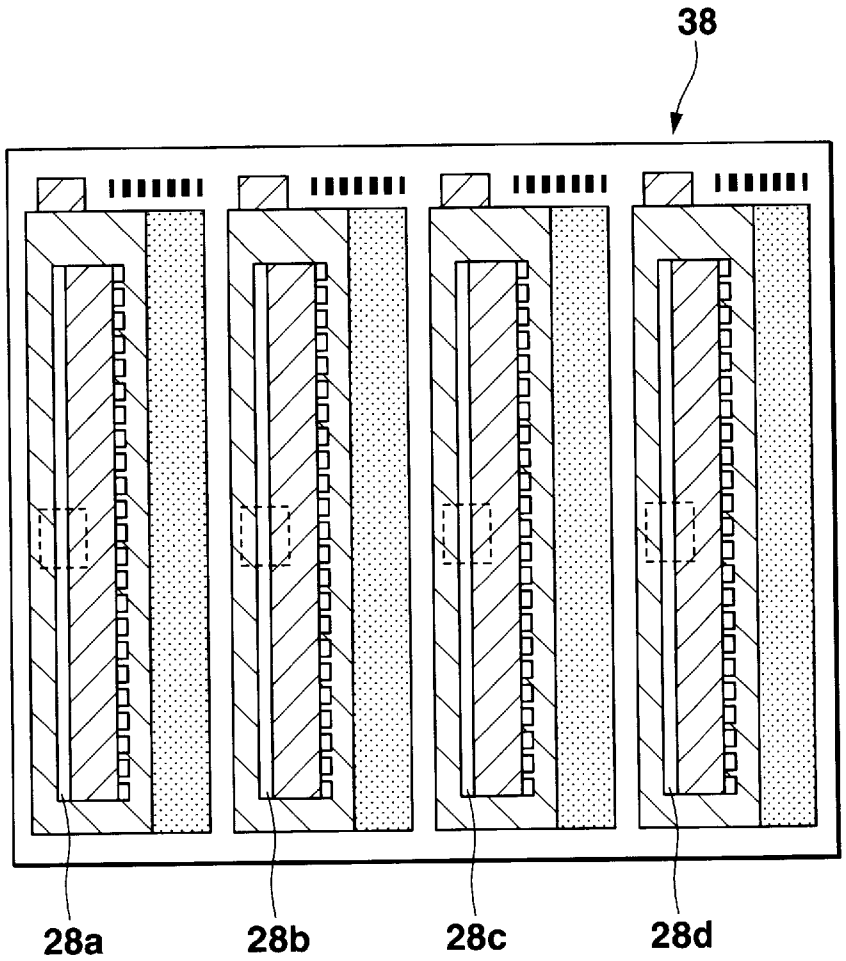
FIG. 8B is another plan view showing the same but an orifice plate is not illustrated to reveal the structure under the orifice plate.
Figure 8A:
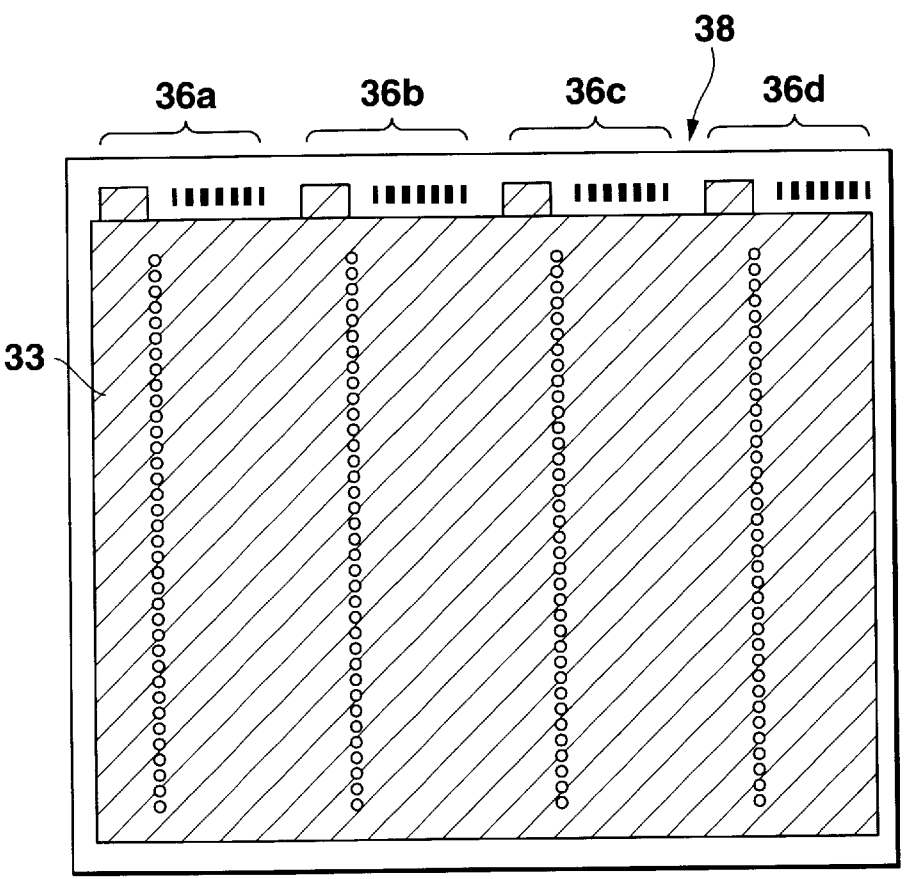
FIG. 8A is a plan view showing a full-color ink-jet printer head having four ink-jet printer head modules according to the first embodiment.

FIG. 8A is a plan view showing a print head 38 having four print head modules 36 for full-color printing. FIG. 8B is another plan view showing the print head 38 in which the orifice plate 33 is eliminated for revealing the structure of four-line print head modules 36.

As shown in FIGS. 8A and 8B, the full-color print head 38 comprises four print head modules 36*a*, 36*b*, 36*c*, and 36*d*. In the print head 38, for example, yellow ink is supplied to the heating areas 25 in the print head module 36*a* via a common ink supply groove 28*a*, magenta ink is supplied to the heating areas 25 in the print head module 36*b* via a common ink supply groove 28*b*, cyan ink is supplied to the heating areas 25 in the print head module 36*c* via a common ink supply groove 28*c*, and black ink is supplied to the heating areas 25 in the print head module 36*d* via a common ink supply groove 28*d*.

In addition to the above described fundamental steps, the present invention features a maneuver for making corrosion resistant electrodes (common electrodes 21 and individual electrodes 23) which is executed after step 2. That is, a barrier layer is formed on the electrode layer. The barrier layer forming process will now be described in detail.

Figure 9:
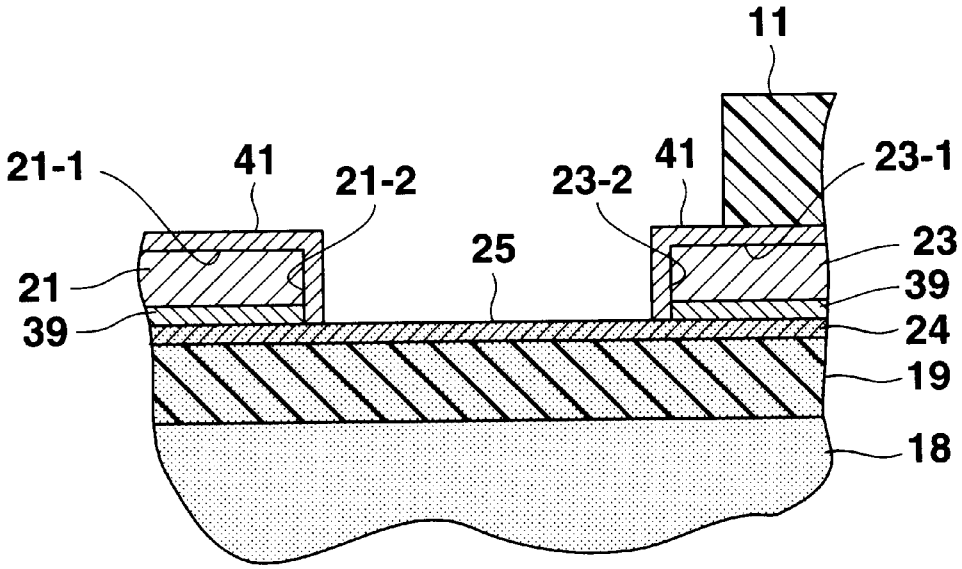
FIG. 9 is a cross sectional view schematically showing the structure of a heating element in the ink-jet printer head according to the first embodiment of the present invention.
Figure 10:
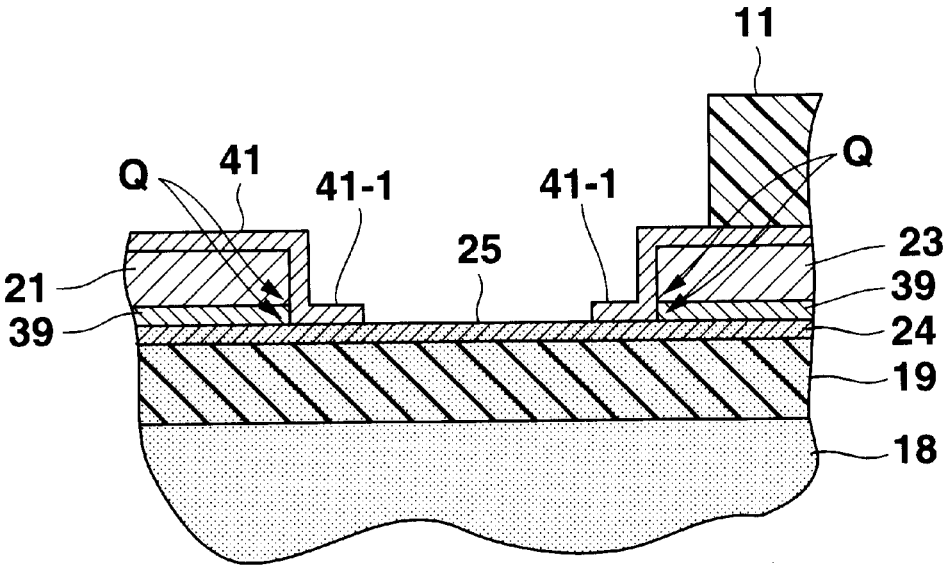
FIG. 10 is a cross sectional view schematically showing the modified structure of a heating element in the ink-jet printer head according to the first embodiment of the present invention.

FIG. 9 is a cross sectional view schematically showing the structure of one of heating elements, and FIG. 10 is a cross sectional view showing another structure. FIG. 9 shows one of multiple heating elements formed through step 2. That is, the heating element comprises the heating resistor piece 24 whose one end is covered with the contact layer 39 on which the common electrode piece 21 is superimposed, while the other end is covered with the contact layer 39 on which the individual electrode piece 23 is superimposed so that the heating area 25 is exposed. The chip substrate 18 on which the insulation layer 19 is formed has thus formed multiple heating elements thereon.

The heating area 25 will directly contact ink because it is exposed as shown in FIG. 9. This structure realizes efficient energy usage for boiling the ink. However, if the common electrode 21 and the individual electrode 23 are also exposed to the ink in the same manner, corrosion or migration occurs, and the electrodes are deteriorated.

To avoid such the problem, a barrier layer 41 (10 to 1,000 nm thick) is formed on the electrodes (common electrodes 21 and individual electrodes 23) of the heating elements after the heating elements are formed through step 2. The barrier layer 41 is a protective layer having resistance against erosion such as the corrosion and the migration caused by ink, water, and other reactive substances. Proposed materials suitable for the barrier layer 41 are, for example, single atomic metal such as Ta and Ti, oxide of Ta or Ti, corrosion resistant amorphous alloy such as tantalum-aluminum (Ta—Al), titanium nitride, and titanium-tungsten (Ti—W).

As shown in FIG. 9, the barrier layer 41 is formed on the common electrodes 21 and the individual electrodes 23 so that the electrodes 21 and 23 are not exposed to ink in the ink flow passage 32. More precisely, not only top surfaces 21-1 and 23-1, also an edge 21-2 and both side edges (not shown) of the stacked common electrode 21 and contact layer 39, and an edge 23-2 and both side edges (not shown) of the stacked individual electrode 23 and the contact layer 39 are covered with the barrier layer 41. In other words, the barrier layer 41 covers the electrodes 21, 23 and the contact layer 39 so as to prevent them from being exposed to the ink. Thus formed barrier layer 41 will protect the aluminum (amphoteric metal) electrode from being solved into the ink, or prevent the migration from occurring at the contact surfaces between the heating resistor layer and the Au electrodes, because of high resistance against the corrosion. As a result, the electrodes are prevented from being peeled off from the heating resistor.

Electroless plating is one of suitable methods for forming the barrier layer 41. The electroless plating is carried out in accordance with ordinary process but employs complex compound solution of single atomic metal such as Ta and Ti. According to the electroless plating under the above condition, the barrier layer 41 made of single atomic metal having the thickness of 10 to 1,000 nm is formed. Thus formed barrier layer 41 has constant thickness with uniformity over the surfaces of the electrodes 21 and 23 which should be covered. Not only the electroless plating, ordinary electrolytic plating may be employed for forming the barrier layer 41.

The barrier layer formation may employ the photolithography technique. In this case, a corrosion resistant barrier layer is formed on the chip substrate 18 on which a plurality of heating elements have been formed. The sputtering or spin coating is employed to form a corrosion resistant barrier layer over the chip substrate 18. Then, ordinary photolithography process is executed for patterning the barrier layer. Thus, the barrier layer 41 is formed only on required areas.

In this case, the formed barrier layer 41 should have margins for complete covering even if the mask for the patterning deviates. More precisely, the barrier layer 41 has margins 41-1 which seal edges of the heating areas 25, as shown in FIG. 10. According to this structure, the barrier layer 41 covers edges of the stacked electrode 21(23) and the contact layer 39, and seals boundary seams Q between the contact layer 39 and the heating resistor 24/the electrode 21(23) completely, even if the mask deviates during the patterning. This structure improves yielding through the manufacturing process. Since all of the boundary seams Q are completely sealed by the barrier layer 41, the migration is prevented more effectively rather than the case shown in FIG. 9.

It is generally known that contact-potential difference between outer electric potentials (Volta potential difference) of two conductors being in contact with each other causes tunnel effect. In a case where, for example, two metals ($\alpha$,$\beta$) having no charges being in contact with each other, electrons transfer from one metal having smaller work function of electron to another having larger work function of electron by the tunnel effect. After electrochemical potentials in the metals are equaled to each other by the electron transfer, they are equilibrated. If the electrodes 21 and 23 (metal) and the heating resistor 24 are exposed to electrolytic ink, anode dissolving reaction occurs repeatedly before equilibration appears. Such the anode dissolving reaction promotes corrosion, as a result the print head will be broken eventually.

The above described structure shown in FIGS. 9 and 10 allows only the heating areas 25 to contact the ink, while the electrodes 21 and 23 are prevented from contacting the ink. In this structure, electron transfer by the tunnel effect is impossible matter. Therefore, anode dissolving reaction does not occur. As a result, excellent heating element against corrosion by ink is realized, moreover, the resistance is effective for a long time.

Second Embodiment

A print head according to a second embodiment of the present invention will now be described with reference to FIG. 11. Like or same reference numeral as used in FIG. 9 are also used in FIG. 11 to denote corresponding or identical components.

The print head according to the second embodiment comprises a protective insulation film formed on the barrier layer 41. The protect film is effective in preventing extra bubbles from being generated by electrolysis in the ink.

Figure 11:
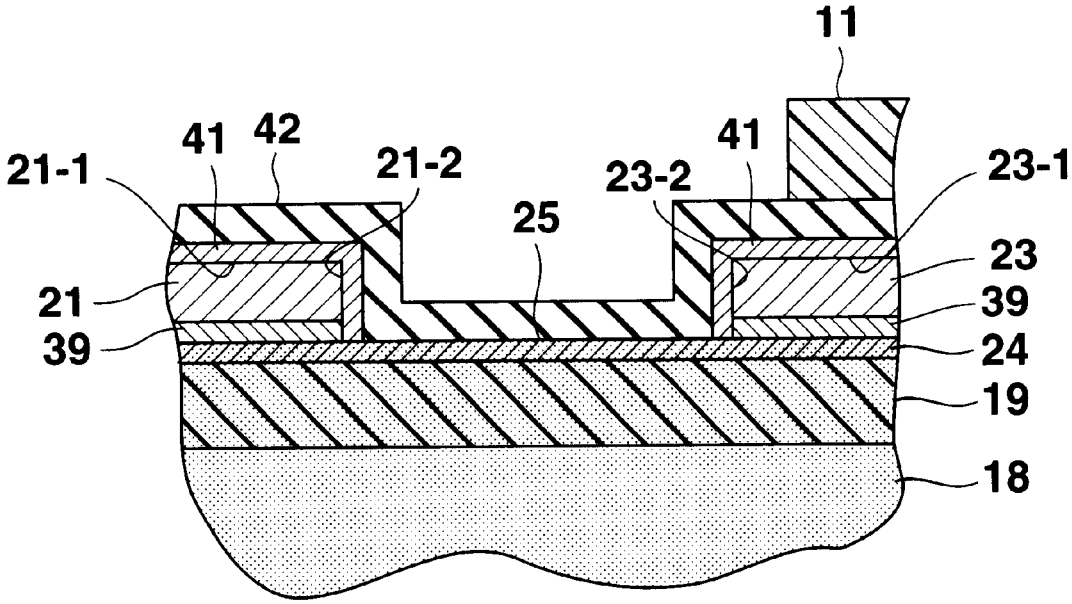
FIG. 11 is a cross sectional view schematically showing the structure of a heating element in the ink-jet printer head according to the second embodiment of the present invention.

As shown in FIG. 11, a protective insulation film 42 is formed so as to cover the barrier layer 41 and the heating area 25. Material of the protective insulation film 42 is Ta—Si—O. The composition elements of the protective insulation film 42 are similar to those of the heating resistor film 24 (Ta—Si—O—N), but composition ratios between them are different. That is, composition ratio of O to others in the protective insulation film 42 is higher than that in the heating resistor film 24, therefore, the protective insulation film 42 shows better performance as an insulator.

Since the protective insulation film 42 is made of Ta—Si—O, it adheres well to the barrier layer 41 made of Ti—W or the like. Moreover, since composition elements of the protective insulation film 42 (Ta—Si—O) are similar to those of the heating resistor 24 (TaSi—O—N), they also adhere well to each other. Accordingly, the protective insulation film 42 firmly adheres to the surface of the heating element, that is, over the barrier layer 41 and the heating area 25.

In addition to the barrier effect of the barrier layer 41 which is effective in resisting against dissolving corrosion and migration, the protective insulation film 42 insulates the heating elements from the ink.

The protective insulation film 42 is also effective in preventing a short circuit current from occurring. The short circuit current may occur in the monolithic structure in which the drive circuits 26 and the heating elements are mounted on the same chip 18. In this case, the short circuit current flows between the electrodes of the heating element (common electrode 21 and individual electrode 23) and a ground circuit of the semiconductor substrate via the ink. The short circuit current causes electrolysis in the ink, thus extra bubbles are generated. Those extra bubbles block ink flow, as a result, ink output performance is deteriorated. Since the protective insulation film 42 exists between the electrodes 21 and 23 of the heating element and the ink, occurrence of the short circuit current via the ink is prevented certainly, thus, the electrolysis in the ink does not occur.

In a case where the common electrodes 21 and the individual electrodes 23 are formed on the contact layer 39, the electrodes 21 and 23 are likely to overhang. In this embodiment, the barrier layer 41 is formed on the electrodes 21 and 23 so as to cover the edges of the electrodes 21, 23 and the contact layer 39, and the protective insulation film 42 is formed on the barrier layer 41. According to this structure, the previously formed barrier layer 41 buffers the overhangs of the electrodes 21 and 23, thus the protective insulation film 42 formed on the barrier layer 41 will have smooth surface because it is not affected by the overhangs of the electrodes 21 and 23. In other words, the above structure realizes excellent step coverage, thus, necessary insulation is accomplished.

According to the above, the protective insulation film 42 is formed even on the heating area 25 in order to improve cavitation resistance of the heating area 25, however, the protective insulation film 42 on the heating area 25 deteriorates energy efficiency of heat emission by the heating area 25. In a case where priority is given to energy efficiency rather than cavitation resistance, the protective insulation film 42 may be formed except the heating area 25.

Various embodiments and changes may be made thereunto without departing from the broad spirit and scope of the invention.

The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

The present invention is applicable not only to the thermal ink-jet printer but also to other ink-jet printers which generate pressure energy to output ink.

Applicable insulation substrate is not limited to the silicon substrate on which an oxidized insulation film is formed. The present invention may employ a glass substrate, a ceramics substrate, or the like, that is, a substrate itself is made of insulation material. The present invention is applicable to a non-monolithic ink-jet printer in which the drive circuits are separated from a head substrate.

This application is based on Japanese Patent Application No. H11-151322 filed on May 31, 1999 and including specification, claims, drawings and summary. The disclosure of the above Japanese Patent Application is incorporated herein by reference in its entirety.

What is claimed is:

1. An ink-jet printer head in which ink is pressed out in predetermined directions by vapor bubbles generated by heating the ink, said ink-jet printer head comprising:

an insulation substrate at least a surface thereof is an insulator;

a plurality of heating resistors which are formed on said insulation substrate, each of which has a heating area which emits heat when a predetermined voltage is applied thereto;

a pair of electrodes which is electrically connected to each of said heating areas;

a wall which is formed on said insulation substrate to determine an ink flow passage; and a barrier layer, having resistance against corrosion caused by the ink, which covers said electrodes so that said electrodes are not exposed to the ink in said ink flow passage.

2. The ink-jet printer head according to claim 1, wherein said barrier layer is made of amorphous metal alloy.

3. The ink-jet printer head according to claim 1, wherein said barrier layer is made by electroless plating.

4. The ink-jet printer head according to claim 1, wherein said electrodes are superimposed on said heating resistors except said heating areas.

5. The ink-jet printer head according to claim 4 further comprising a contact layer formed between said electrodes and said heating resistors to interconnect said electrodes and said heating resistors.

6. The ink-jet printer head according to claim 4, said barrier layer covers top surfaces and edges of the electrodes.

7. The ink-jet printer head according to claim 1, wherein said barrier layer is formed on each of said electrodes and predetermined regions on said heating areas.

8. The ink-jet printer head according to claim 1, wherein said heating areas are uncovered by said barrier layer to be exposed.

9. The ink-jet printer head according to claim 1 further comprising a protective insulation film formed over said heating areas and said barrier layer.

10. The ink-jet printer head according to claim 9, wherein said heating resistors are made of Ta—Si—O—N, said barrier layer is made of Ti—W, and said protective insulation film is made of Ta—Si—O.

11. An ink-jet printer head in which ink is pressed out through nozzles in predetermined directions by providing pressure to the ink, said ink-jet printer head comprising:

pressure generators, disposed within an ink flow passage communicating to said nozzles, which provide pressure to the ink when a predetermined voltage is applied thereto;

electrodes which are terminals for providing the predetermined voltage to said pressure generators; and a barrier layer, having resistance against corrosion caused by the ink, which covers said electrodes so that said electrodes are not exposed to the ink in said ink flow passage.

12. A manufacturing method of an ink-jet printer head in which ink is pressed out in predetermined directions by vapor bubbles generated by heating the ink flowing in an ink flow passage, said method comprising:

forming a plurality of heating elements by forming heating resistors, each having a heating area which emits heat when a predetermined voltage is applied thereto, on an insulation substrate and forming pairs of electrodes on said heating resistors except said heating areas;

forming a barrier layer, having resistance against corrosion caused by the ink, which covers said electrodes so that said electrodes are not exposed to the ink in said ink flow passage.

13. The method according to claim 12, wherein said forming barrier layer comprises forming said barrier layer of amorphous metal alloy.

14. The method according to claim 12, wherein said forming barrier layer comprises forming said barrier layer by plating.

15. The method according to claim 14, wherein said forming barrier layer comprises forming said barrier layer by electroless plating.

16. The method according to claim 12, wherein said forming barrier layer comprises forming said barrier layer by photolithography.

* * * * *

UNITED STATES PATENT AND TRADEMARK OFFICE

CERTIFICATE OF CORRECTION

PATENT NO. : 6,350,017 B1
DATED : February 26, 2002
INVENTOR(S) : Hideki Kamada

It is certified that error appears in the above-identified patent and that said Letters Patent is hereby corrected as shown below:

Column 12,
Line 44, after "comprising" insert -- the steps of --.

Signed and Sealed this

Twenty-sixth Day of August, 2003

JAMES E. ROGAN
*Director of the United States Patent and Trademark Office*